US005411141A

United States Patent [19]

Bounds

[11] Patent Number: 5,411,141

[45] Date of Patent: May 2, 1995

[54] EATING UTENSIL SUPPORT

[76] Inventor: H. Dean Bounds, 5714 Holston Hill Rd., Knoxville, Tenn. 37914-5136

[21] Appl. No.: 190,995

[22] Filed: Feb. 3, 1994

[51] Int. Cl.[6] ..... B65D 85/00; A47G 21/14

[52] U.S. Cl. ..... 206/553; 211/70.1; 248/37.3; 248/174

[58] Field of Search ..... 206/147, 486, 553; 211/60.1, 69.1, 69.9, 70.1, 70.7; 248/37.3, 37.6, 174; 229/938

[56] References Cited

U.S. PATENT DOCUMENTS

| | | | |
|---|---|---|---|
| D. 156,958 | 1/1950 | Hoeft | D44/29 |
| 1,635,911 | 7/1927 | Vegkley . | |
| 1,647,154 | 11/1927 | Soybel | 211/70.1 |
| 1,753,878 | 4/1930 | Burnham . | |
| 2,289,619 | 7/1942 | Anderson, Jr. | 211/70.1 |
| 2,313,620 | 3/1943 | Brunner | 211/70.1 |
| 2,639,081 | 5/1953 | Metzger | 211/70.7 |
| 2,807,361 | 9/1957 | Junkin | 206/75 |
| 3,263,820 | 8/1966 | McFadden | 211/70.1 |
| 3,366,232 | 1/1968 | Elfstrom et al. | 211/70.1 |
| 3,915,213 | 10/1975 | Graham, Jr. | 150/52 C |
| 4,770,379 | 9/1988 | Estvold | 248/174 |
| 4,834,328 | 5/1989 | Hall | 248/37.3 |
| 4,858,863 | 8/1989 | Lin | 211/70.7 |
| 4,905,947 | 3/1990 | Henne et al. | 248/174 |
| 4,940,199 | 7/1990 | Hall | 248/37.3 |
| 5,005,704 | 4/1991 | Martin | 206/564 |

*Primary Examiner*—Jimmy G. Foster
*Attorney, Agent, or Firm*—Pitts & Brittian

[57] ABSTRACT

A support (10) for elevating eating utensils above the surface (52) of a table. The support (10) is fabricated from a material that may be easily and safely disposed. The support (10) is constructed with minimal effort and time. The support (10) is constructed from a single sheet (12) of material such as a heavyweight paper. The support (10) defines four panels (14), each separated one from another by relief lines (30,32,34). The end panels (14A,D) overlap one another to define a first side (16). The two middle panels (14B,C) define a second side (18) and the bottom (20) of the support (10). In order to maintain the close relationship of the end panels (14A,D), a plurality of tab members (26) is defined on the end panel (14D) and extends toward its edge (24). A plurality of receptacles (40) is provided for receiving the handle portion of each utensil (50). Each receptacle (40) is defined by cooperating openings (36,38) defined in the end panels (14A,D) and the middle panel (14B). An indicia region (44) is provided for imprinting a selected message thereon, preferably on the panel (14B). The supports (10) of the present invention may be fabricated in large quantities, with a plurality of supports (10) being fabricated simultaneously from a single sheet (46) of material.

7 Claims, 3 Drawing Sheets

EATING UTENSIL SUPPORT

TECHNICAL FIELD

This invention relates to the field of eating utensils. More specifically, this invention relates to a device for supporting eating utensils before and during the course of a meal such that the utensils are suspended above the surface of the table and do not make contact therewith.

BACKGROUND ART

In the field of restaurant dining, it is well known that tables are used continuously. After one party has completed their meals, the table is quickly cleaned and the next party is seated. Often, due to the demand of the particular restaurant, inadequate cleaning is performed and the table is left in an unsanitary condition. For example, the table may be wiped down with a wet rag, but that rag may be filthy, leaving residue on the surface of the table.

After a meal has begun, even if the table is clean, it is often a problem for the diners to place their eating utensils such that they are not in the way. It is undesirable for them to lay their utensils directly on the table, so they typically resort to laying them in some fashion on their plates, be it their dinner plate, their salad plate, or their bread plate.

Other devices have been produced to provide a holding receptacle for eating utensils or food. Typical of the art are those devices disclosed in the following U.S. Pat. Nos.:

| U.S. Pat. No. | Inventor(s) | Issue Date |
|---|---|---|
| 1,635,911 | A.H. Vegkley | Jul 12, 1927 |
| 1,753,878 | C.W. Burnham | Apr 8, 1930 |
| 2,807,361 | M.P. Junkin | Sep 24, 1957 |
| 3,915,213 | N. Graham, Jr. | Oct 28, 1975 |
| 5,005,704 | R.E. Martin | Apr 9, 1991 |
| Des. 156,958 | C.R. Hoeft | Jan 24, 1950 |

Of these devices, the Martin ('704) device is provided for holding a taco. The '704 device is fabricated from a disposable material and is folded such that a taco may be received between a pair of upwardly extending members. The inner faces of these members are contoured to cooperate one with the other to substantially define the cross-sectional contour of a taco. However, the '704 device does not teach the retention of eating utensils. If used for such, the utensils would still be resting directly on the surface of the table.

Those devices disclosed by Vegkley ('911), Burnham ('878), and Junkin ('361) are each provided for holding eating utensils. However, these devices are designed to hold a complete set, or a substantial portion of a complete set of utensils. Although they may be used to hold one place setting of utensils, such use would be cumbersome as each of these devices is of a rather large construction. Further, due to the materials of fabrication, it is clear that these devices are not intended to be disposed after each use thereof. Although the '361 device disclosed by Junkin may be considered to be disposable, the construction is relatively complex and would not be practical in a restaurant, especially when time is of the essence in maximizing table usage.

The device disclosed by Hoeft ('958) is a utensil rack designed to hold three individual utensils. However, it is apparent that the '958 device is intended for holding utensils such as spoons used during the preparation of food. It is not clear how the '958 device could be used to securely retain a knife.

The '213 device disclosed by Graham, Jr., is designed to retain one place setting of eating utensils. Each of the individual utensils is received within a separately defined receptacle. Each receptacle defines a volume substantially filled with a foam rubber material. A slot is defined for the knife, while depressions contoured to match the bottom faces of the fork and spoon are provided for each of those, respectively. Due to the materials of fabrication of the '213 device, it is apparent that this device is intended for the display or storage of the utensils. It is feasible that the '213 device may be used at a dinner table. However, after the utensils are removed and used, they could not be placed back in or on the device without causing an undue amount of labor in cleaning the foam rubber or expense in replacing the same.

Therefore, it is an object of this invention to provide a means for supporting a single place setting of eating utensils above the top surface of a dining table such that the utensils do not have to contact the table.

It is another object of the present invention to provide such a means whereby the device may be easily constructed in a minimal amount of time.

Still another object of the present invention is top provide such a device that may be disposable.

Yet another object of the present invention is to provide a device for supporting eating utensils while additionally providing a medium for advertisement.

DISCLOSURE OF THE INVENTION

Other objects and advantages will be accomplished by the present invention which serves to support and elevate a single place setting of eating utensils above the surface of a table. The support is fabricated from a material that may be easily and safely disposed. The support is constructed with minimal effort and time. An indicia region is provided in which advertisement or other selected indicia may be placed.

The support is constructed from a single sheet of material such as a heavyweight paper. The support defines four panels, the end panels overlapping one another to define a first side when the support is constructed. The two middle panels define a second side and the bottom of the support.

In order to maintain the close relationship of the end panels, a plurality of tab members is defined on one end panel and extends toward its edge. The other end panel is folded over the one end panel and the edge of the other end panel is inserted under each of the tab members and is thus secured.

Relief lines are provided for enabling the folding of the support. The relief lines define the individual panels. The relief lines may be impressions in the sheet, or may alternatively by perforations.

Receptacles are provided for receiving the handle portion of each piece of flatware. There may any selected number of receptacles such as three. However, there may be fewer or more than three receptacles. Each receptacle is defined by cooperating openings defined in the end panels and one of the middle panels, each of these panels comprising the first and second side panels of the support. Each receptacle defines a selected width and depth depending upon the particular physical characteristics of the utensil to be supported therein.

In an alternate embodiment of the eating utensil support, the tab members may be oriented toward the relief lines, with cooperating slotted openings being defined in the opposing end panel. The tab members are received within the slotted openings when the panels are folded along the relief lines.

Still another alternate embodiment is defined by three panels, with the terminating ends being secured together with adhesive tape or any other conventional fastening means. In this embodiment, one of the end panels defines the bottom of the support.

An indicia region is provided for imprinting a selected message thereon. The indicia region is preferably defined on the panel which comprises the second side of the support. However, it will be understood that the indicia region may be provided on either or both of the sides.

The supports of the present invention may be fabricated in large quantities, with a plurality of supports being fabricated simultaneously from a single sheet of material.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An eating utensil support incorporating various features of the present invention is illustrated generally at 10 in the figures. The eating utensil support, or support 10, is designed for supporting a single place setting of eating utensils 50, or flatware, before and during the course of a meal. In the preferred embodiment, the support 10 is fabricated from a material that may be easily and safely disposed. The support 10 is constructed with minimal effort and time. Moreover, in the preferred embodiment the support 10 is designed to provide a region in which advertisement or other indicia may be placed.

Figure 1:
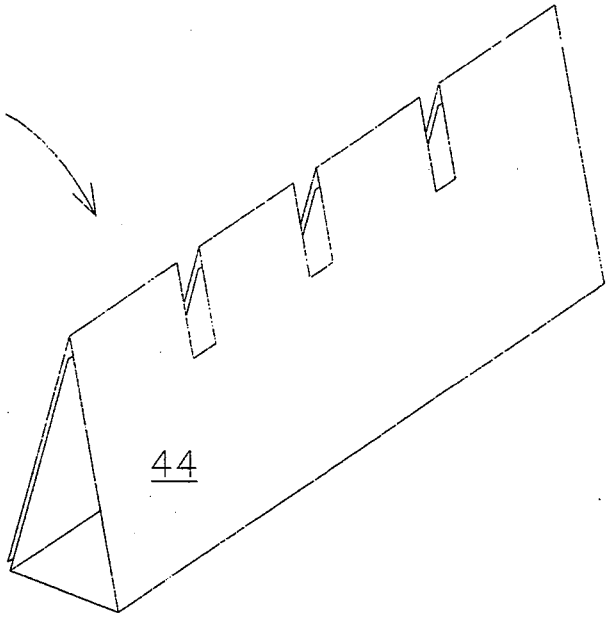
FIG. 1 is a perspective view of the eating utensil support constructed in accordance with several features of the present invention.

As illustrated in FIG. 1, the support of the preferred embodiment is configured such that the flatware supported is elevated above the surface 52 of the table such that no contact is ever necessary between the flatware workpiece and the table. Of course, the handle portion may contact the table at its distal end.

Figure 3:
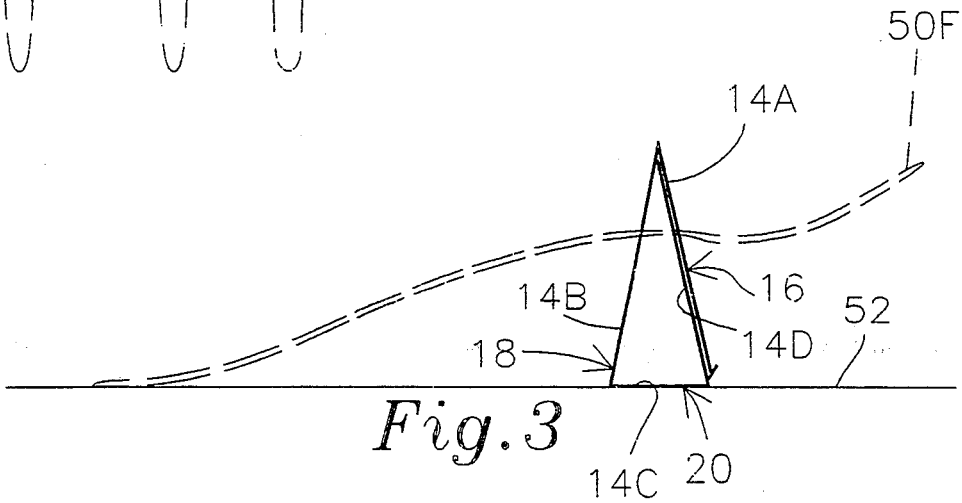
FIG. 3 is an end view, in section of the eating utensil support taken along 3—3 of FIG. 2.

The support of the preferred embodiment is constructed from a single sheet 12 of material such as a heavyweight paper. One such paper that has been used is 60# bond paper. It will be seen that this type of material may provide further benefits in that it may be manufactured from recycled product and that it may itself be recycled. The support defines four panels 14. The end panels 14A,D overlap one another to define a first side 16 when the support 10 is constructed, as can more clearly be seen in FIG. 3. The two middle panels 14B,C define a second side 18 and the bottom 20 of the support 10.

In order to maintain the close relationship of the end panels 14A,D, a plurality of tab members 26 is defined on the end panel 14D and extends toward the edge 24. The end panel 14A is folded over end panel 14D and the free edge 22 of the end panel 14A is inserted under each of the tab members 26. Due to the weight and stiffness of the sheet 12 of paper, the edge 22 of the top panel 14A is maintained under the tab members 26. Further, when the utensils 50 are engaged by the support 10, the weight of the utensils 50 serves to further maintain the relative positions of the end panels 14A,D. It is envisioned, though not shown, that a strip of adhesive tape or other similar fastener may be used to secure the position of the end panels 14A,D.

Figure 4:
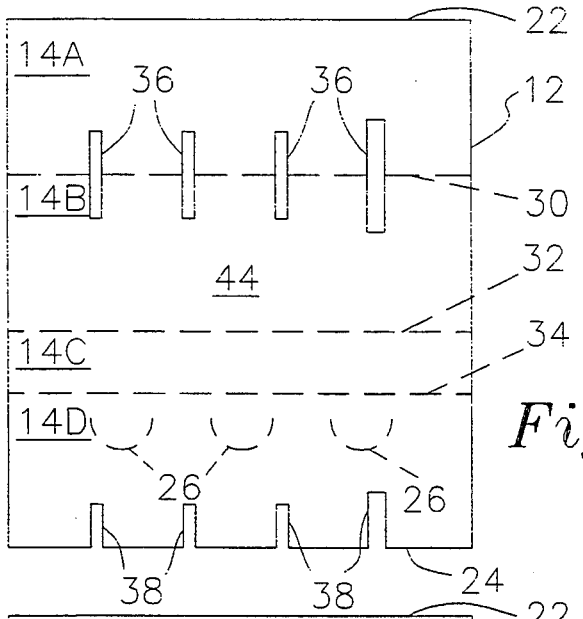
FIG. 4 is a plan view of the eating utensil support of FIG. 1 prior to construction thereof.

As illustrated in FIG. 4, relief lines 30,32,34 are provided for enabling the folding of the support 10. The relief lines 30, 32, 34 define the individual panels 14A,B,C,D. The relief lines 30,32,34 may be impressions in the sheet 12, or may alternatively by perforations (not shown).

Figure 2:
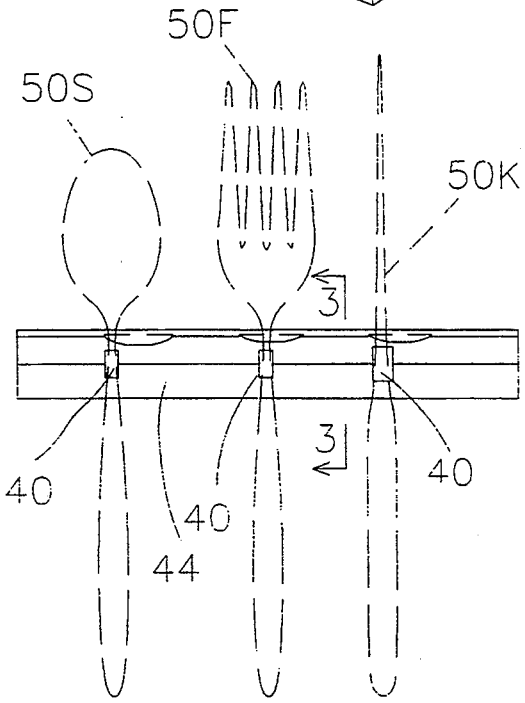
FIG. 2 is a top plan view of the eating utensil support of FIG. 1 showing a typical three piece place setting of eating utensils in phantom.

Receptacles 40 are provided for receiving the handle portion of each piece of flatware. Illustrated in FIGS. 1 and 2 are three such receptacles 40. One each of the receptacles 40 is provided for supporting a knife 50K, a spoon 50S, and a fork 50F. As shown in FIGS. 4, 5, 7 and 9, fewer or more than three receptacles 40 may be provided.

Figure 5:
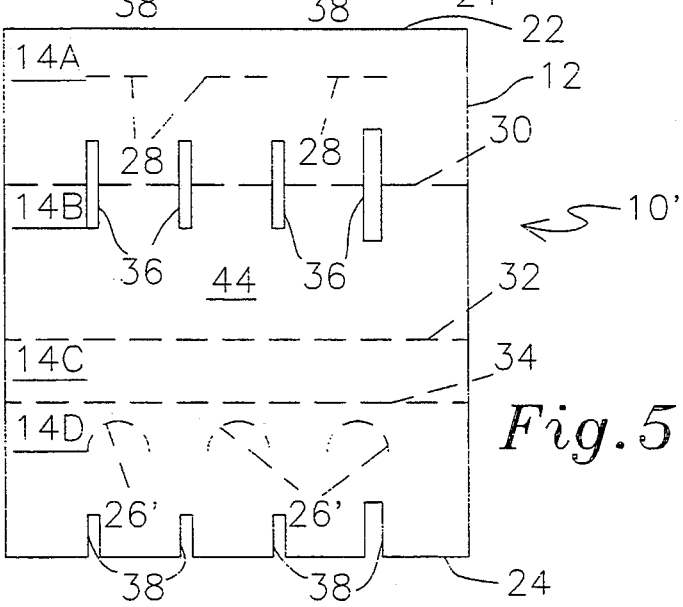
FIG. 5 is a plan view of an alternate embodiment of the eating utensil support prior to construction thereof.

As illustrated in FIGS. 4 and 5, each receptacle 40 of the preferred embodiment is defined by cooperating openings 36,38. The openings 36 are oriented perpendicularly to the relief line 30. The openings 36 are defined by the panels 14A,B and are positioned such that relief line 30 bisects each. Openings 38 are defined by the panel 14D. Each opening 38 is oriented perpendicularly to the edge 24 and terminates at the edge 24. Each opening 38 is approximately one-half as long as its cooperating opening 36. Each receptacle 40 defines a selected width and depth depending upon the particular physical characteristics of the utensil 50 to be supported therein.

Figure 6:
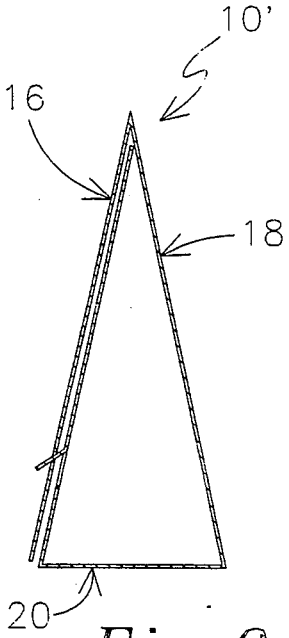
FIG. 6 is an end view, in section of the eating utensil support of FIG. 5.

Illustrated in FIGS. 5 and 6 is an alternate embodiment of the eating utensil support 10' of the present invention. In this embodiment, the tab members 26' are each oriented such each extends toward the relief line 34 between the panels 14C,D. Also provided are cooperating slotted openings 28 defined by the panel 14A. As illustrated most clearly in FIG. 6, when the individual panels 14A,B,C,D are folded along relief lines 30,32,34, the tab members 26' are inserted through the slotted openings 28. The tendency of the panel 14A moving away from the panel 14D will be overcome as the tab members 26' will serve to engage the bottom of the slotted openings 28. Though not shown, it is envisioned that adhesive tape or any other conventional means of permanently securing the relative positions of the panels 14A,D may be incorporated.

Figure 7:
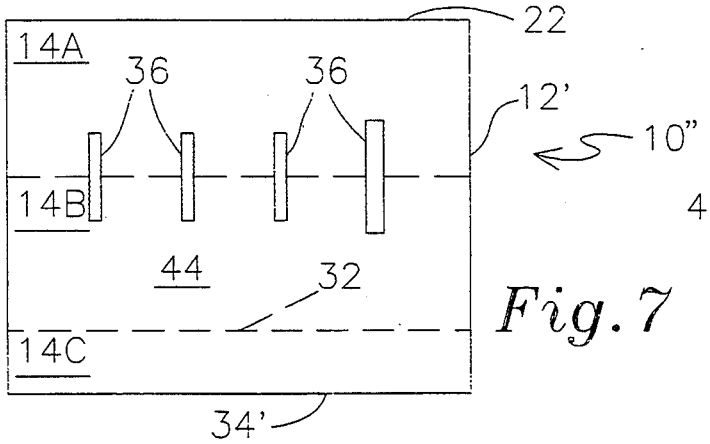
FIG. 7 is a plan view of an alternate embodiment of the eating utensil support prior to construction thereof.
Figure 8:
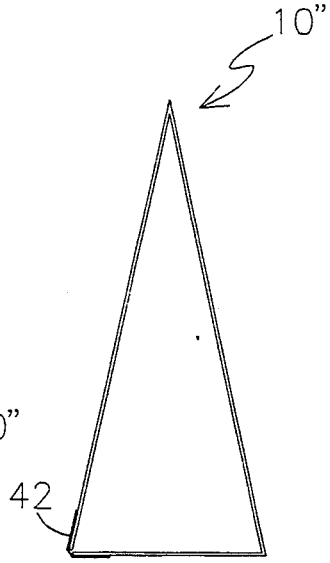
FIG. 8 is an end view, in section of the eating utensil support of FIG. 7.

Illustrated in FIGS. 7 and 8 is an alternate embodiment of the present invention as noted at 10". In this embodiment, the support 10" is comprised of panels 14A,B,C, with the relief line 34 of the previous embodiments serving as a terminating edge 34' of panel 14C. In this embodiment, as illustrated in FIG. 8, the edges 22,34' of panels 14A,C, respectively, are secured one to another as with adhesive tape 42 or any other conventional securement means.

As illustrated in FIGS. 1, 2, 4, 5 and 7, an indicia region 44 is provided for imprinting a selected message thereon. The indicia region 44 is preferably defined on the panel 14B which comprises the second side 18 of the support 10. This is primarily due to the provision of a larger area for such selected indicia. It will be noted that the tab members 26 require a portion of the first side 16 of the support 10. However, it will be understood that the indicia region 44 may be provided on either or both of the panels 14A,B. Illustrative of the messages printed within the indicia region 44 is that indicated—"Happy Holidays" with a pictorial design. Others may include the name of the restaurant, a particular vendor of the restaurant, or any other message such as "Come Back Soon" or "Thank you for your patronage". Of course, the possibilities are infinite.

Figure 9:
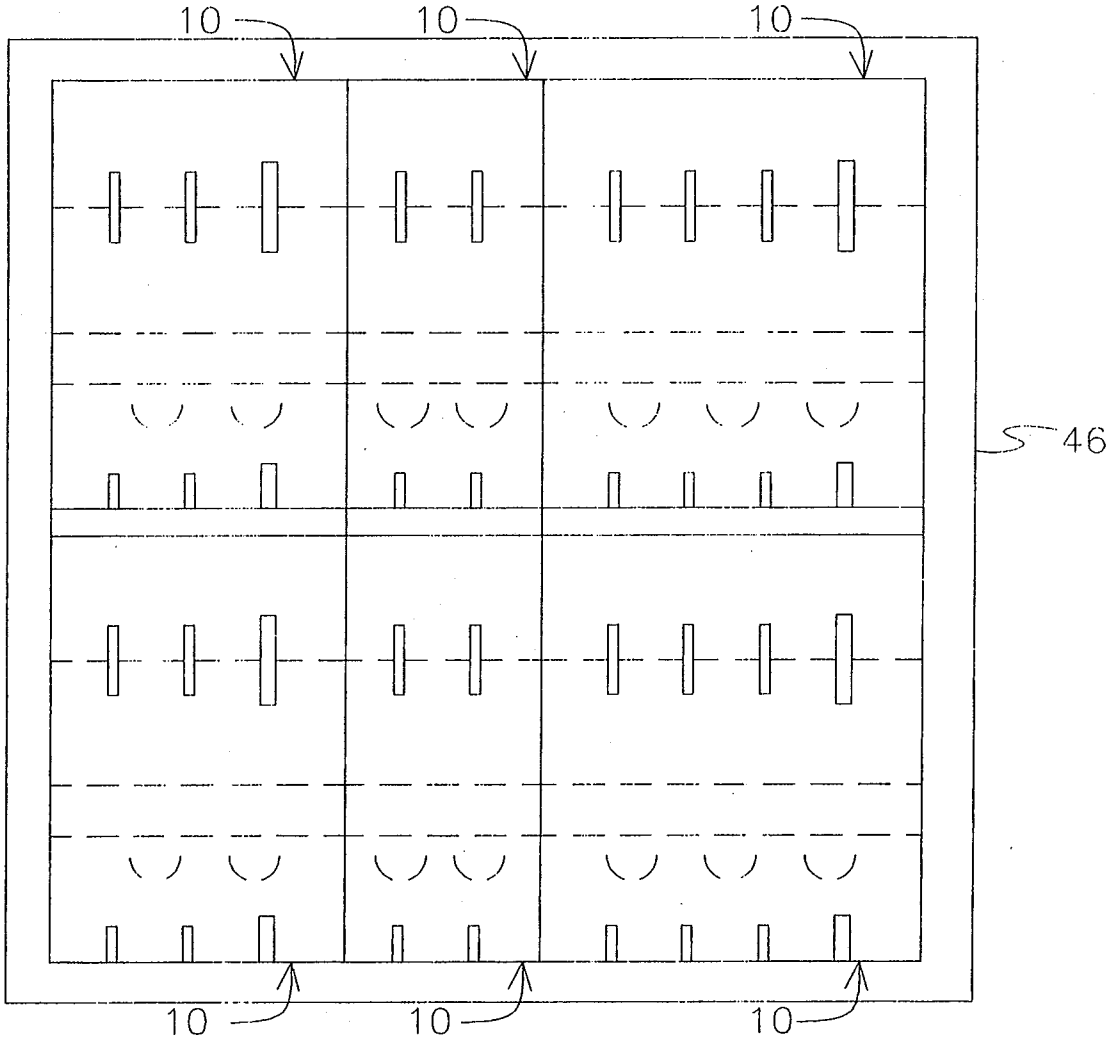
FIG. 9 is a plan view of one preferred layout of a plurality of eating utensil supports arranged on a single sheet of material prior to being cut and folded.

Illustrated in FIG. 9 is one preferred arrangement of supports 10 of the present invention prior to being cut from a single sheet 46 of material. This figure illustrates the ability to produce a plurality of supports 10 simultaneously. This figure further illustrates a variety of sizes of supports 10 being provided for accommodated varying types and sizes of meals and desserts. Illustrated are supports 10 for supporting two, three, and four utensils 50.

From the foregoing description, it will be recognized by those skilled in the art that a eating utensil support offering advantages over the prior art has been provided. Specifically, the eating utensil support provides a device for supporting and elevating a place setting of utensils 50 above the surface 52 of a table. The support 10 of the present invention may be easily produced and constructed. The supports 10 are disposable and inexpensive. Further, the supports 10 of the present invention are provided with an indicia region 44 for the imprinting of a selected message for viewing by the user.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A support for receiving and elevating at least one eating utensil above a support surface, said support comprising:

a continuous sheet of material defining a plurality of relief lines oriented parallel one to another, said relief lines being oriented parallel to a first pair of opposing edges of said continuous sheet and extending between a second pair of opposing edges of said continuous sheet, a plurality of panels being defined by between consecutive pairs of said first pair of opposing edges and said plurality of relief lines;

a plurality of receptacles, one each of said plurality of receptacles being provided for receiving one of said eating utensils, each of said plurality of receptacles being defined by cooperating openings in a first of said plurality of panels, a second of said plurality of panels, and a last of said plurality of panels, said second of said plurality of panels being defined between a first of said plurality of relief lines and a second of said plurality of relief lines; and a fastening device for securing said first of said plurality of panels to said last of said plurality of panels, said first of said plurality of panels being defined between a first edge of said first pair of opposing edges of said continuous sheet and said first of said plurality of relief lines, said last of said plurality of panels being defined between a second edge of said first pair of opposing edges of said continuous sheet and said last of said plurality of relief lines.

2. The support of claim 1 wherein said plurality of panels consists of four panels, and wherein said plurality of relief lines consists of three relief lines.

3. The support of claim 1 wherein said fastening device is comprised of a plurality of tab members defined by said last of said panels, said plurality of tab members being oriented to receive said first edge of said first pair of opposing edges of said continuous sheet.

4. The support of claim 1 wherein said fastening device is comprised of a plurality of tab members defined by said last of said panels and a cooperating plurality of openings defined by said first of said plurality of panels, each of said plurality of tab members being oriented to be received within one each of said plurality of openings defined by said first of said plurality of panels.

5. The support of claim 1 wherein said fastening device is comprised of a plurality of tab members defined by said fourth panel and a cooperating plurality of openings defined by said first panel, each of said plurality of tab members being oriented to be received within one each of said plurality of openings defined by said first panel.

6. A support for receiving and elevating at least one eating utensil above a support surface, said support comprising:

a continuous sheet of material defining first, second and third relief lines oriented parallel one to another, said relief lines being oriented parallel to a first pair of opposing edges of said continuous sheet and extending between a second pair of opposing edges of said continuous sheet, a first panel being defined between a first edge of said first pair of opposing edges of said continuous sheet and said first relief line, a second panel defined between said first relief line and said second relief line, a third panel defined between said second relief line and said third relief line, and a fourth panel defined between said third relief line and a second edge of said first pair of opposing edges of said continuous sheet;

a plurality of receptacles, one each of said plurality of receptacles being provided for receiving one of said eating utensils, each of said plurality of receptacles being defined by cooperating openings in said first panel, said second panel, and said fourth panel; and a fastening device for securing said first panel to said fourth panel.

7. The support of claim 6 wherein said fastening device is comprised of a plurality of tab members defined by said fourth panel, said plurality of tab members being oriented to receive said first edge of said first pair of opposing edges of said continuous sheet.

* * * * *